US007900796B2

(12) United States Patent
Ungrady et al.

(10) Patent No.: US 7,900,796 B2
(45) Date of Patent: Mar. 8, 2011

(54) CONTAINER WITH RECESSED REMOVABLE VENTING TAB

(75) Inventors: Eric B. Ungrady, Mt. Wolf, PA (US); Larry Taylor, Landisville, PA (US)

(73) Assignee: Graham Packaging Company, L.P., York, PA (US)

( * ) Notice: Subject to any disclaimer, the term of this patent is extended or adjusted under 35 U.S.C. 154(b) by 688 days.

(21) Appl. No.: 11/806,975

(22) Filed: Jun. 5, 2007

(65) Prior Publication Data

US 2008/0302807 A1 Dec. 11, 2008

(51) Int. Cl.

| | |
|---|---|
| ***B65D 8/04*** | (2006.01) |
| ***B65D 8/18*** | (2006.01) |
| ***B65D 90/02*** | (2006.01) |
| ***B65D 25/00*** | (2006.01) |

(52) U.S. Cl. ..... 220/745; 220/271; 220/361; 220/669; 220/675; 220/721; 215/383; 215/902

(58) Field of Classification Search ..... 220/271, 220/360, 361, 367.1, 669, 675, 721, 745; 215/902

See application file for complete search history.

(56) References Cited

U.S. PATENT DOCUMENTS

| | | | | |
|---|---|---|---|---|
| 4,239,726 | A | 12/1980 | Weiler et al. | |
| 4,781,314 | A * | 11/1988 | Schoonover et al. | 222/465.1 |
| 4,969,922 | A * | 11/1990 | Platte, Sr. | 215/383 |
| 6,270,488 | B1 * | 8/2001 | Johnson et al. | 604/403 |
| 6,779,678 | B2 * | 8/2004 | Baron | 220/653 |

FOREIGN PATENT DOCUMENTS

| | | |
|---|---|---|
| DE | 2514303 | 10/1975 |
| DE | 19711887 | 10/1998 |
| EP | 1354809 | 10/2003 |

OTHER PUBLICATIONS

International Search Report dated Aug. 4, 2008 from corresponding International Application No. PCT/US2008/065908.

* cited by examiner

*Primary Examiner* — Anthony Stashick
*Assistant Examiner* — Madison L Wright
(74) *Attorney, Agent, or Firm* — Knoble Yoshida & Dunleavy, LLC

(57) ABSTRACT

A container that includes a hollow body having at least a first exterior wall and a recess defined in the first exterior wall A tab is formed integrally with the exterior wall and located in the recess. The tab does not extend substantially beyond the recess. Removal of the tab forms an opening in the first exterior wall of the container.

18 Claims, 5 Drawing Sheets

CONTAINER WITH RECESSED REMOVABLE VENTING TAB

BACKGROUND OF THE INVENTION

1. Field of the Invention

The present invention relates generally to containers having a vent hole. More particularly, the present invention relates to containers having a removable tab to provide an opening for venting the container.

2. Related Art

Plastic containers have become commonplace for holding and dispensing liquids and other fluent products. Some containers, particularly those that are used to store and dispense larger volumes of liquids, for example one gallon or more, are sometimes provided with an orifice and valved closure to allow for dispensing from the container without lifting and pouring. Such containers are frequently inverted when in use, so that the dispensing portion is located at the bottom of the container. In order to facilitate dispensing of the contained product, a venting mechanism is required to relieve headspace vacuum that develops as the container is evacuated. Previous methods for creating an opening include manually drilling a hole, or forming the container with a second finish and closure, where removal of the second closure provides the required opening.

One potential use of such large containers is in automated dispensing machines, for example soda and drink machines such as those used in the food service industry—restaurants, fast-food establishments and the like. In this system, a concentrate, for example a drink concentrate or soft drink syrup, is shipped to the user in a container that is placed in the dispensing machine. The concentrate is dispensed from the container through tubing to the mixing and dispensing nozzle, where, upon opening of a valve in the dispensing nozzle, the concentrate is mixed with a diluent, for example water, which may be carbonated or into which carbonation may be introduced, and the mixed product dispensed ready to drink. Alternatively, the container may contain a premixed product that can be dispensed without mixing.

Various containers exist for such uses, but are subject to several limitations. In many cases, a rigid container is used that must be provided with a vent opening. As described above, typical systems can require creating a vent hole by cutting or punching a hole, or by providing a secondary structure, such as a finish and closure, on the top of the container. Elimination of a requirement for drilling or punching a hole in the container would provide a much more convenient and easier to use container, and avoiding use of a finish and closure to create a vent circumvents added expense in the manufacturing process. As alternative system uses a collapsible bag contained within a box (bag-in-a-box). As the concentrate is dispensed, the inner bag collapses within the box, which is open to the outside, to prevent formation of a vacuum within the box. The bag-in-a-box system is difficult to fill, resulting in slow line speeds during processing. The multiple components required by such a system also add complexity and expense to manufacturing and processing. By reducing the number of components by eliminating the need for a second finish or a two component system can also provide a potential cost savings to a user.

Current systems also suffer from limitations with respect to product storage. For example, some existing containers require that the contents be frozen upon filling and remain frozen during storage in order to preserve the freshness of the contained product. In addition to the costs and inconvenience of storing such a product, there are problems with product consistency as filling is often done with a partially frozen product. In other systems, preservatives are used to prevent spoilage during storage. These preservatives are generally undesirable and can detract from the flavor of the product when dispensed.

There remains a need for a container in which a vent hole can be created without the need for tools or secondary structures and which can withstand the rigors of shipping and handling. There also remains a need for a container that can facilitate processing and storage of product, that is simpler to manufacture.

BRIEF SUMMARY OF THE INVENTION

In summary, a container includes a hollow container body having at least a first exterior wall having a recess defined therein, and a tab formed integrally with the first exterior wall and located in the recess. The tab does not extend substantially beyond the recess; and removal of the tab forms an opening in the first exterior wall. The tab can have at least a portion defining a hollow channel contiguous with the hollow container body and can be flattened in a plane substantially perpendicular to the first exterior wall. The container first exterior wall can include a substantially planar outermost portion. The recess can be defined by a recess bottom wall, that extends from an outermost portion of the first exterior wall, to a recess back and a recess top wall that extend from the recess back to an overhang. The recess bottom wall can extend upward from the front wall and form an angle of greater than 90 degrees with respect to the front wall, as viewed from the perspective of the interior of the container. The recess top wall can extend downward from the overhang and form an angle with respect to the overhang of greater than 90 degrees, when viewed from the perspective of the interior of the container. The overhang front can be recessed with respect to the front wall. The container can also include a right sidewall and a left sidewall attached to opposite sides of the first exterior wall, and the recess can extend substantially from the left sidewall to the right sidewall. The container can also have a top wall, and the overhang can include a portion of the top wall. The overhang further can have a right side portion extending from the overhang front portion to the recess back and proximal to the right sidewall and, a left side portion extending from the overhang front portion to the recess back proximal to the left sidewall. A bottom wall of the container can include an outlet, which can have a finish with a structure to securing a closure, such as threads. A central portion of the left sidewall can contact a central portion of the right sidewall.

Embodiments of the invention include a method for making the container described above that includes the steps of providing first and second mold halves configured for forming any of the above described embodiments, extruding a hollow parison between the mold halves, such that a portion of the parison is positioned at the tab forming region of the mold halves, contacting the first mold half and the second mold half, to compress the portion of the parison in the tab forming region, injecting a gas into the hollow parison to inflate the parison, moving the first and second mold halves into a spaced apart position, and releasing the container. The tab can be formed flattened in a plane perpendicular to the first exterior wall. The method can also include one or more of the steps of forming an opening in a bottom wall of the container, forming a finish in the bottom wall of the container and the forming the opening in the finish. The parison can be made of a plastic, for example, but not limited to polyethylene and polypropylene, which can be a multi-layered plastic material.

The invention satisfies a need for a container in which a opening hole can be created without the need for tools and therefore facilitating ease of use. The invention also satisfies a need for a large container that can be used to dispense a fluid that does not require a secondary structures and which can withstand the rigors of shipping and handling.

This invention differs from the prior art in modifications which were not previously known or suggested. The positioning of a tear off tab as in the present invention has not been previously used or suggested.

Further objectives and advantages, as well as the structure and function of preferred embodiments will become apparent from a consideration of the description, drawings, and examples.

BRIEF DESCRIPTION OF THE DRAWINGS

The foregoing and other features and advantages of the invention will be apparent from the following, more particular description of a preferred embodiment of the invention, as illustrated in the accompanying drawings wherein like reference numbers generally indicate identical, functionally similar, and/or structurally similar elements.

DETAILED DESCRIPTION OF THE INVENTION

Embodiments of the invention are discussed in detail below. In describing embodiments, specific terminology is employed for the sake of clarity. However, the invention is not intended to be limited to the specific terminology so selected. While specific exemplary embodiments are discussed, it should be understood that this is done for illustration purposes only. A person skilled in the relevant art will recognize that other components and configurations can be used without parting from the spirit and scope of the invention. All references cited herein are incorporated by reference as if each had been individually incorporated.

As used herein, terms such as "front," "back," "left," "right," "top," and "bottom" are used to describe positions relative to one another only and not to denote an absolute position. For example, a "top" can become a "bottom" by inverting a container, although it can still be referred to as the top side of the container.

The present invention solves the problem of creating a vent opening in a way that has not previously been contemplated. One way of forming an opening in a container is to provide a twist off tab which, upon removal, creates a hole in the container. This arrangement has been used in, for example, a single serve drink container in which the tab extends from the top of the container and can be removed to create an opening for dispensing of a product. Current arrangements of such tabs are not practical for large containers. For example, food service containers may be subject to rough handling during shipping storage and use. In such as environment, a tab extending from the container would have a substantial chance of being knocked from the container, creating and opening and resulting in inadvertent spillage. To this end, embodiments of the present invention utilize a tab that can be removed to create a vent in the container and that is positioned within a recess in the container wall. This can provide a convenient method for forming a vent and is protected from inadvertent removal.

The present invention can also be formed by a blow molding process with a configuration and material that is amenable for use in a hot fill process. In a hot fill process, the product is added to the container at an elevated temperature, about 82° C., and the container is capped. By using a hot fill process, product retains freshness during prolonged storage without the need to add excessive amounts of preservatives and without the need for freezing during storage. Thus, processing and storage can be accomplished at a reasonable cost and a high quality product can be maintained.

Figure 1:
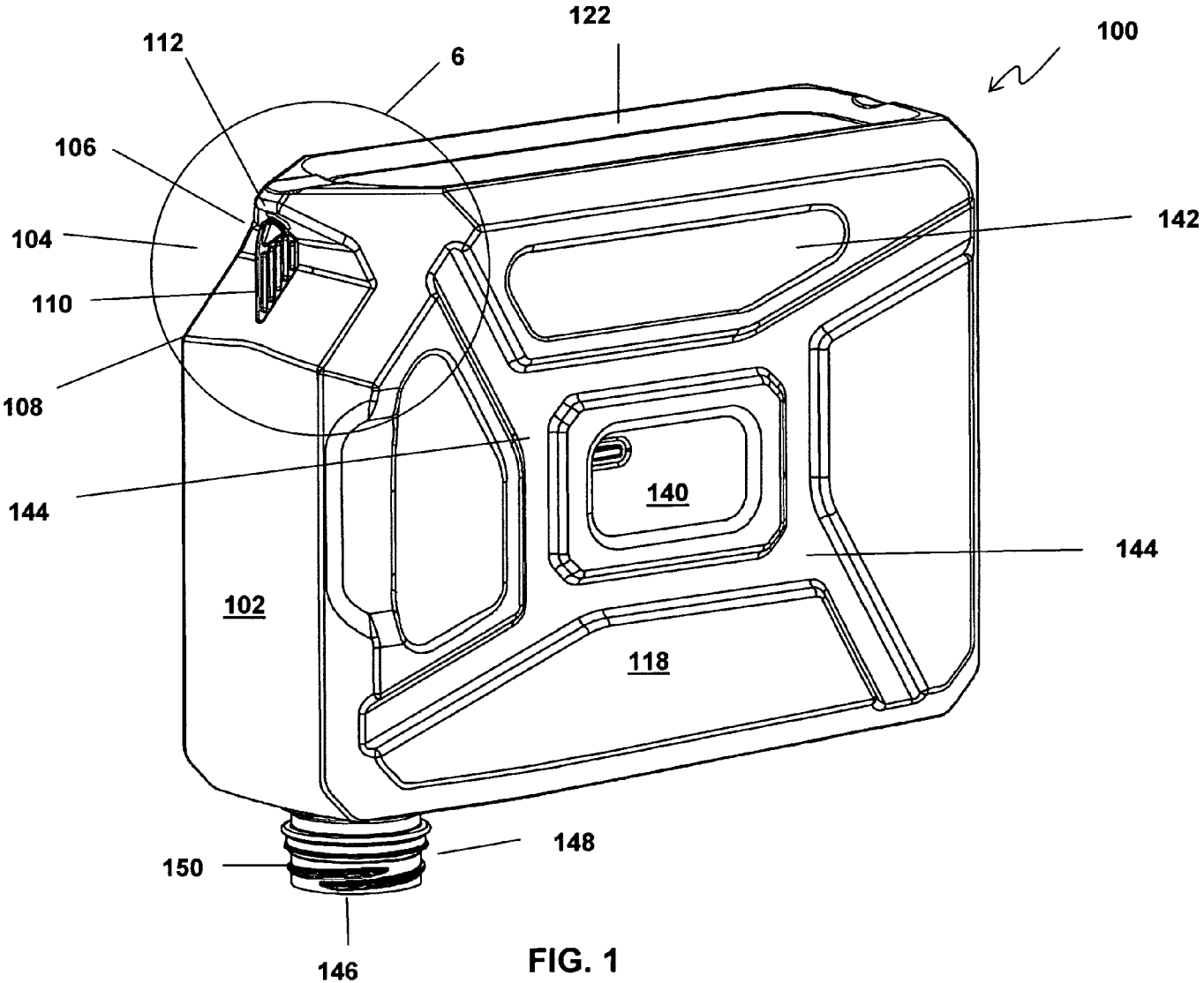
FIG. 1 depicts a perspective view of a container according to an exemplary embodiment of the present invention.
Figure 2:
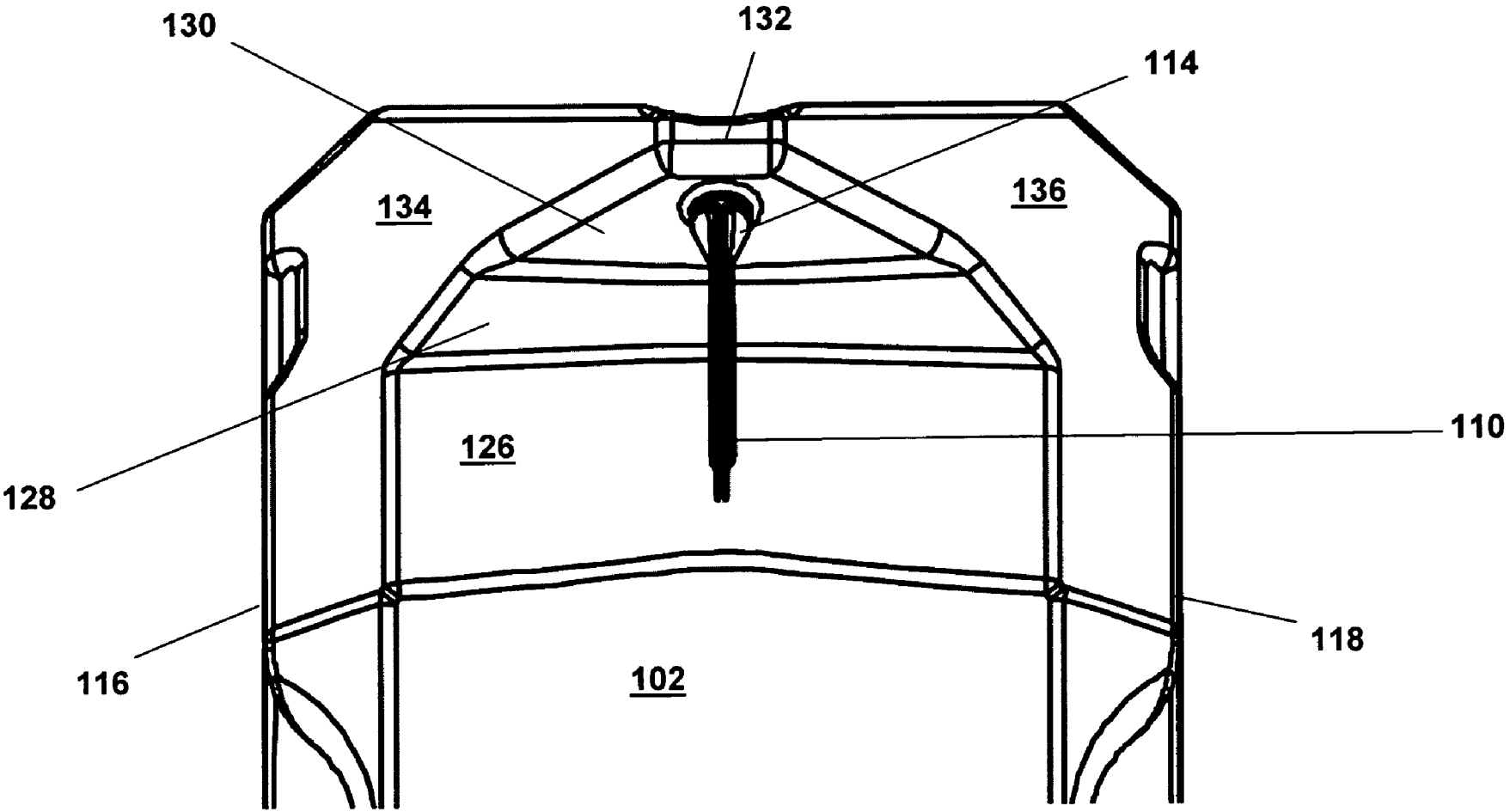
FIG. 2 depicts a front view of a container according to an exemplary embodiment of the present invention.
Figure 3:
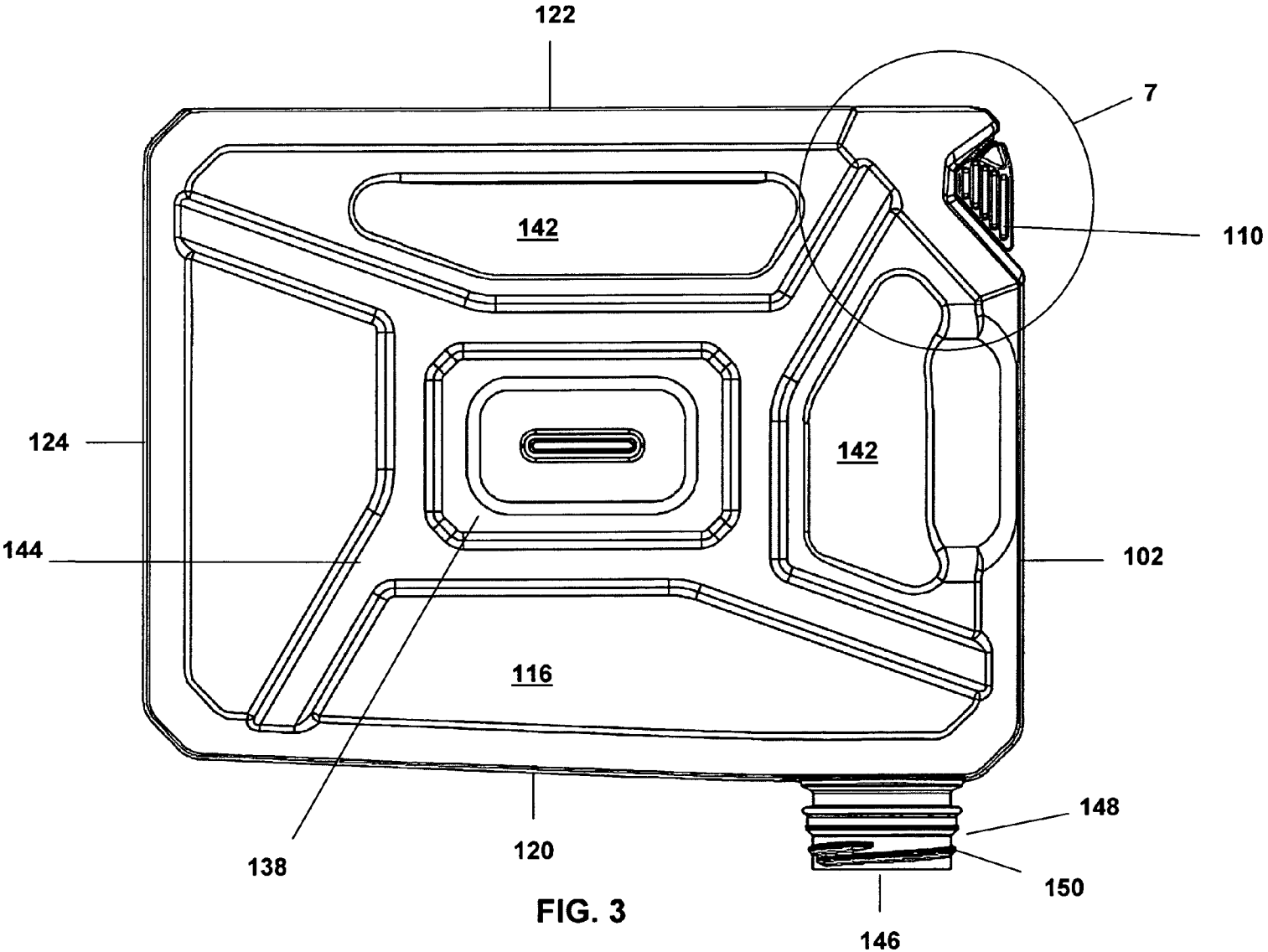
FIG. 3 depicts a right side view of a container according to an exemplary embodiment of the present invention.
Figure 4:
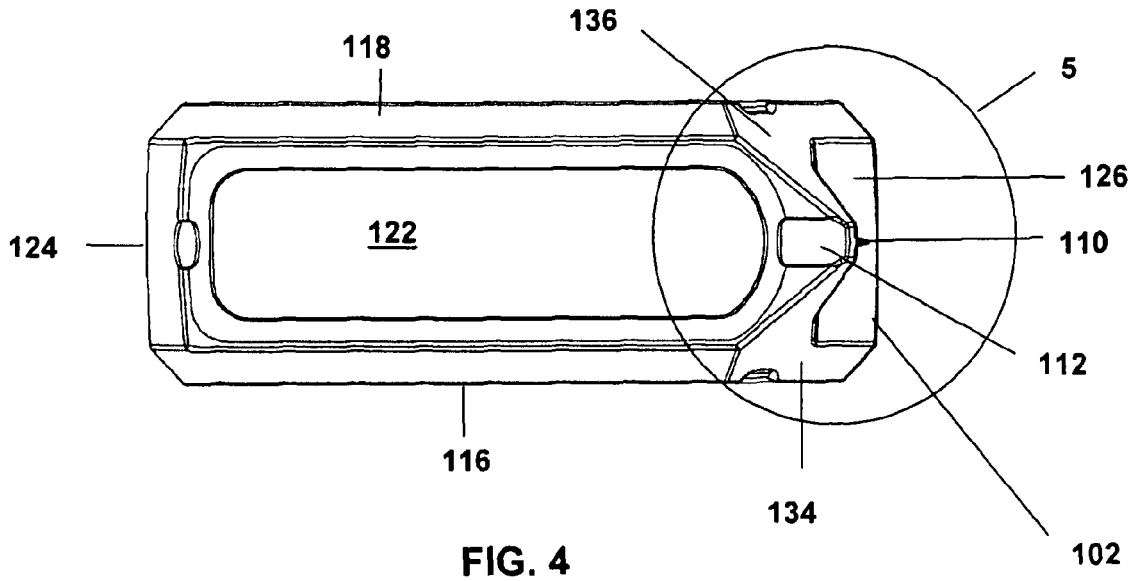
FIG. 4 depicts a top view of a container according to an exemplary embodiment of the present invention.
Figure 5:
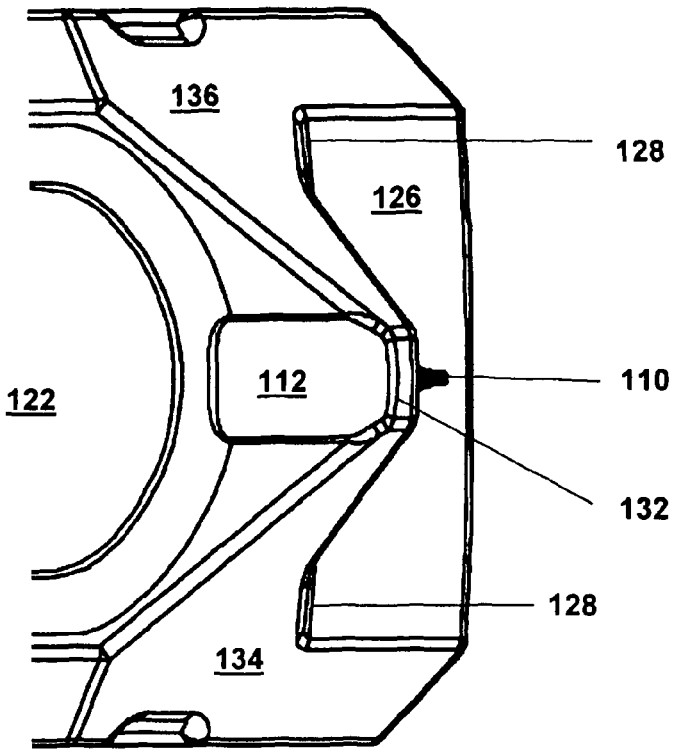
FIG. 5 depicts a detail of the top view of FIG. 4.
Figure 6:
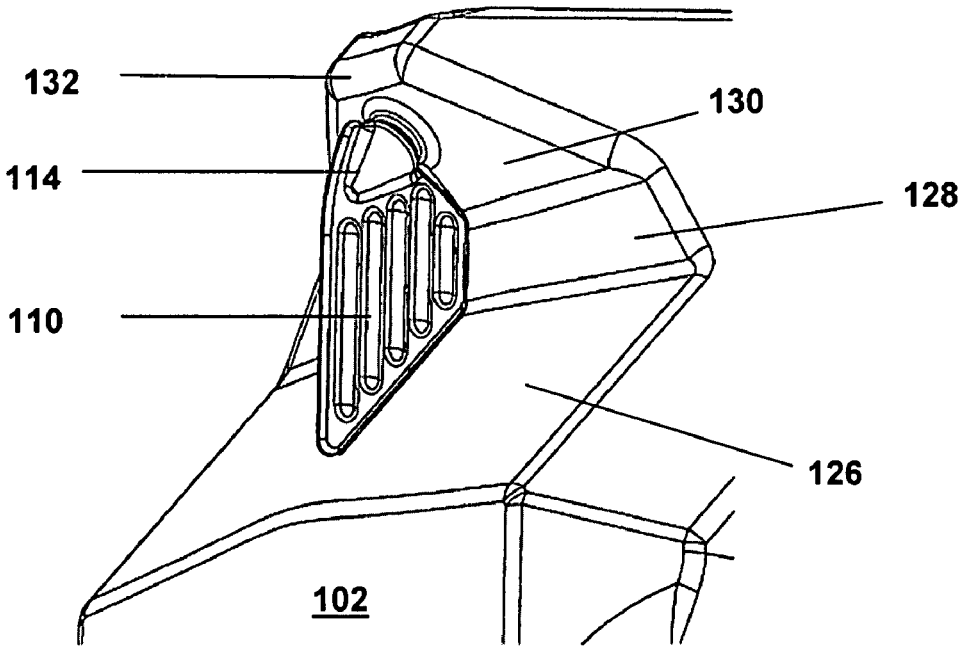
FIG. 6 depicts a detail of the perspective view of FIG. 1.
Figure 7:
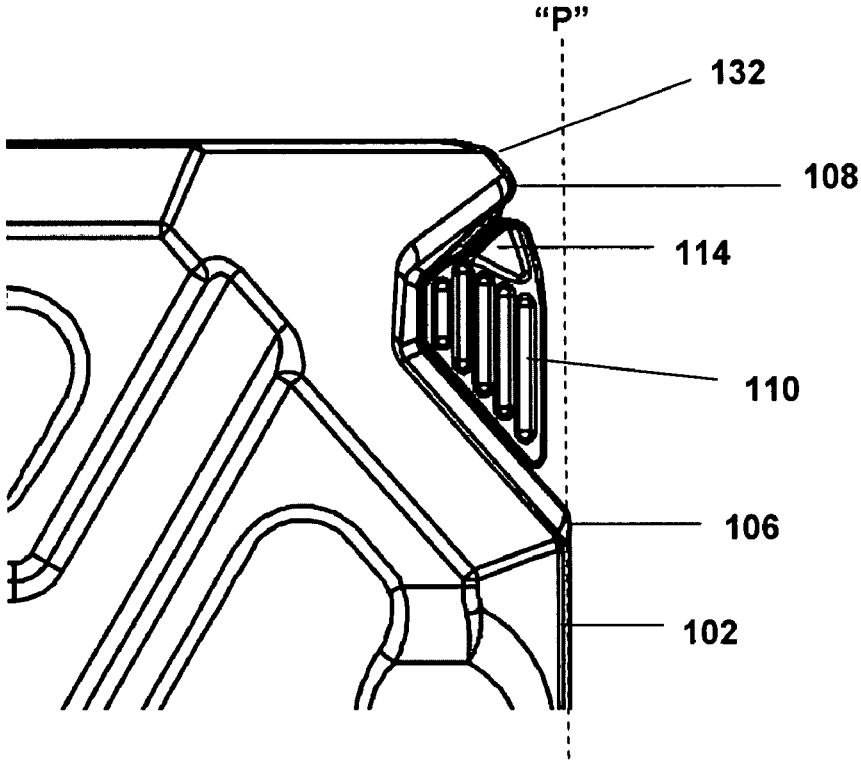
FIG. 7 depicts a detail of the side view of FIG. 3.

As illustrated in FIGS. 1-7, the present invention is directed to a hollow container 100 with a first exterior wall 102 which, in the illustrated embodiment, is a front wall. The first exterior wall 102 can have at least a portion that is substantially planar. The exterior wall includes a recess 104. The recess can define an upper edge 106 and a lower edge 108 with the exterior wall. A tab 110 is formed integrally with the first exterior wall 102, for example, between the upper and the lower edges 106, 108. The tab 110 is positioned such that it does not extend substantially beyond the recess 104, i.e. beyond an outermost portion of the exterior wall. For example, in the illustrated embodiment, the front wall is substantially planar and the lower edge 108 of the recess 104 is formed where the recess meets the substantially planar portion of the front wall 102. As shown, the outermost edge of the tab 110 does not extend beyond the plane "P" (see FIG. 7) defined by the outermost portion of the first exterior wall 102. As can also be seen, in this embodiment, the top edge 106 is formed at an overhang 112, which is also recessed with respect to plane "P." The tab 110 extends slightly beyond the overhang 112 in the illustrated embodiment. Positioning of the tab 110 substantially within the recess 104 helps prevent the inadvertent dislodging of the tab during shipping and normal handling prior to use.

The tab 110 is formed in a configuration such that, upon removal of the tab, for example by twisting, an opening is formed in the container 100. This can be accomplished by using configurations of known tabs. In some embodiments, the tab includes a portion 114 that defines a hollow channel contiguous with the interior of the container. In an exemplary embodiment, the tab is substantially flat and can be solid through most of its extent. In such an embodiment, twisting results in a severing of the tab from the container at a position along the hollow channel forming portion 114, thus creating an opening in the container.

In embodiments of a container according to the invention that are intended for dispensing a product from the bottom, the opening created by removal of the tab 110 can provide a vent hole to prevent a vacuum from forming in the head space as the contents are evacuated from the container 100. The vent hole should be located in the portion of the container that becomes the upper part of the container during use. Alternatively, the opening may be used as a dispensing opening. In this embodiment, the opening can be located in the bottom of the container. If the container is relatively small, the opening can be at any position.

As shown in the Figures, a container 100 according to the invention can include a right sidewall 116, a left sidewall 118, a bottom wall 120, a top wall 122, a front wall 102, and a back wall 124. In the embodiment illustrated herein, the exterior wall 102 having the recess 104 can be a front wall of the container. In the illustrated embodiment, the front wall includes a substantially planar portion. Alternatively, the front wall may be flat or curved, for example defining an arc of a cylinder. The recess of this exemplary embodiment is defined by a recess bottom wall 126 that extends from the front side 102 to a recess back 128. As viewed moving from the container bottom up the container front wall, the recess bottom wall 126 of this embodiment angles toward the interior of the container at an angle of about 45°, thus forming an angle with the front wall of greater than 90° or about 135° from the perspective of the interior of the container. At the top of the recess back 128, a recess top wall 130 extends toward the front wall to the overhang 112. As viewed moving from the recess back upward 128, the recess top wall 130 of this embodiment angles toward the exterior of the container at an angle of about 45°, thus forming an angle with the overhang of greater than 90° or about 135° from the perspective of the interior of the container. The illustrated embodiment is particularly designed for dispensing a liquid from the bottom 120. Accordingly, the recess 104 and tab 110 are positioned proximal the side 122 which is, in use, the top of the container. Removal of the tab 110 provides an opening in the container for venting, i.e. to prevent formation of a vacuum in the head space of the container, thereby facilitating evacuation of a product from the container.

In the illustrated embodiment, the recess back 128 includes a relatively flat portion that is approximately parallel to the front wall 102. However, the recess back 128 may be a curvilinear or rounded portion extending between the recess top wall 130 and recess bottom wall 126. Similarly, the recess bottom wall 126 and recess top wall 130 are illustrated as having flat portions, but may be curved in either a concave or convex direction throughout the extent. The recess 104 extends substantially across the container, from the left sidewall 118 to the right sidewall 116. In particular, the recess bottom wall 126 and recess back 128 extend from the right sidewall 116 to the left sidewall 118. As will be appreciated by persons skilled in the art, such a configuration helps accommodate formation of the container by a blow molding process by allowing a position for withdrawal of the mold halves used to form the container.

In the embodiment shown by the Figures, the overhang does not extend outwardly to meet the plane "P" defined by the front wall of the container (see FIG. 7), i.e. the overhang front 132 is recessed with respect to the container front wall. However, as will be appreciated, the overhang front 132 can extend to a position along the plane "P" or even slightly but not substantially beyond the plane P. The overhang front 132 is the forwardmost extending portion of the overhang in the direction toward the plane P. In the illustrated embodiment, the overhang front includes a region that is approximately planar and parallel to plane P. The illustrated embodiment also includes a substantially planar overhang right side portion 134 that extends from the recess back wall 128 and the container right sidewall 116 to the overhang front 132. Similarly, a substantially planar overhang left side portion 136 extends from the recess back wall 128 and the container left sidewall 118 to the overhang front 132.

The tab of the illustrated embodiment is substantially flattened in a direction perpendicular to the front wall. The tab fits substantially within the recess and, although it extends slightly beyond the overhang 112 (see FIGS. 5-6), it does not extend beyond the plane defined by the front wall 102 (see FIG. 7). As will be appreciated, the tab 110 can extend slightly beyond the front wall 102 and still be substantially within the recess as that terminology is used herein. The flattened tab includes an approximately conical portion 114 that defines an interior hollow channel. Removal of the tab 110 results in a severing of the portion 114, opening the hollow channel, and creating an opening in the container. As will be appreciated, other configurations of the tab can be used that may result in an opening. For example, the tab may be hollow throughout its extent, may be a shape other than flat, the hollow portion may have other shapes or there may be no hollow portion at all. The only requirement for the tab is that its removal result in an opening in the container.

FIGS. 1-7 illustrate a container according to an embodiment of the invention that can be used as a container for a drink or drink concentrate in a commercial drink dispensing machine. The particular embodiment of the illustrations contains multiple features that facilitate the particular use. For example, the tab 110 is protected on three sides by the recess top wall 130, recess back wall 128 and recess bottom wall 126 to prevent break-off during filling and handling, and is removed to provide venting after the container is installed into the dispensing machine. As will be appreciated, different specific configurations that embody the invention can be used for the same or other purposes. Examples of additional uses for which modifications of the invention may be useful include large detergent dispensing containers and large drink containers that can be placed, for example, on a refrigerator shelf and dispensed without moving.

Embodiments of the present invention can also have structural features to further improve hot fill performance. For example, the right sidewall 116 and left sidewall 118 can each have a recessed portions 138, 140, respectively, that can be in a central portion of the sidewalls. These recessed portions can be formed to knit or weld together during molding in order to help prevent bulging or other deformation of the container during handling. The weld or knit can be formed by compression molding during the molding process. The sidewalls can also include one or more additional recessed portions 142 that can function as handles. Additional grooves and channels 144 can be present to provide additional rigidity to the container. The structures described above can individually and collectively aid in providing structural stability to the container 100. The stability is useful for large containers and during hot-fill processing.

As indicated above, the illustrated embodiment can be used to dispense a product in a food service dispensing machine. Accordingly, the bottom wall 120 of the container can include an outlet 146 for dispensing a product. It is useful for the outlet 146 to include a means for connecting a tube for dispensing of a product. Thus, the outlet can include a finish 148 that has a means for securing a closure or other fitment to cover the outlet 146. The means for securing a closure or fitment can be, for example, threads 150, as illustrated, or a snap-fit arrangement or other suitable means. In one example of use, the container is positioned in an appropriate location for attachment to a dispensing machine. While being held in a position that does not allow the product to be released, i.e. with the outlet 146 positioned at the top of the container, the container is opened, for example by forming an opening in the outlet by cutting or by removal of a closure or seal attached to the outlet. The appropriate tubing is then connected to the outlet 146 or finish 148 using the securing means. The container is then repositioned for dispensing such that the outlet is in a downward facing position. The tab 110 is next removed, for example by twisting, and the container is ready for dispensing a product.

In an exemplary embodiment, the container for use in a dispensing machine can hold about one gallon of concentrate.

When configured in this way, the container can be about 100 cm (3.94 in.) side, about 198 cm (7.79 inches) wide and about 265 cm (10.43 inches) deep.

The present container can be made by conventional blow molding processes including, for example, extrusion blow molding, stretch blow molding and injection blow molding. Extrusion blow molding is an exemplary method of forming the container. In an extrusion blow molding method, first mold half second mold halves configured for forming the container are provided. A hollow parison or molten plastic is extruded between the first mold half and second mold half, and a portion of the parison is positioned at a tab forming region of the first and second mold halves. The first mold and second mold halves are brought into contact. In an exemplary embodiment the tab forming region of the first and second mold halves form at least a portion of the tab by compression molding, i.e. by compressing a portion of the hollow parison to the extent that opposite sidewalls contact one another forming a solid, flattened tab. A portion of the tab can be left open, i.e. uncompressed, to allow for entry of an inflating gas. An inflating gas, for example, air, is injected into the hollow parison to inflate the parison and, if present, a portion of the tab. Inflating the portion of the tab creates a hollow channel contiguous with the interior of the container. The first and second mold halves are then separated into a spaced apart position, and the container is released.

As formed, the container can include extra material, or often referred to as flash when present at the region where the molds come together, or as a moil, if intentionally present above the container finish. After the mold halves open, the container drops out and is then sent to a trimmer or cutter where any flash or moil is removed. The finished container may have a visible ridge formed where the two mold halves used to form the container came together. This ridge is often referred to as the parting line.

In the container as formed, the outlet 146 may be closed. In such cases, it may be necessary to form an opening in the outlet 146, unless the outlet is to be opened at the point of use. Where the outlet is to be formed during the manufacturing process, it can be formed by, for example, reaming. In such cases, after manufacturing is complete and the container is filled, the outlet can be sealed by, for example, placing a closure on the outlet finish or placing a seal, such as an induction seal or glued on seal, over the opening of the outlet.

The container 100 has a one-piece construction and can be prepared from a monolayer plastic material, such as a polyamide, for example, nylon; a polyolefin such as polyethylene, for example, low density polyethylene (LDPE) or high density polyethylene (HDPE), or polypropylene; a polyester, for example polyethylene terephthalate (PET), polyethylene naphtalate (PEN); or others, which can also include additives to vary the physical or chemical properties of the material. For example, some plastic resins can be modified to improve the oxygen permeability. Alternatively, the container can be prepared from a multilayer plastic material. The layers can be any plastic material, including virgin, recycled and reground material, and can include plastics or other materials with additives to improve physical properties of the container. In addition to the above-mentioned materials, other materials often used in multilayer plastic containers include, for example, ethylvinyl alcohol (EVOH) and tie layers or binders to hold together materials that are subject to delamination when used in adjacent layers. A coating may be applied over the monolayer or multilayer material, for example to introduce oxygen barrier properties.

In an exemplary embodiment, the present container is prepared from a polyolefin such as HDPE. In other embodiments, a multi-layered structure is utilized. An exemplary multilayer structure comprises an outer layer of HDPE and an inner layer of polypropylene. Another exemplary multilayer structure comprises an EvOH barrier layer and polypropylene or HDPE. Other suitable multilayer structures are known in the art and can be utilized with the invention.

The embodiments illustrated and discussed in this specification are intended only to teach those skilled in the art the best way known to the inventors to make and use the invention. Nothing in this specification should be considered as limiting the scope of the present invention. All examples presented are representative and non-limiting. The above-described embodiments of the invention may be modified or varied, without departing from the invention, as appreciated by those skilled in the art in light of the above teachings. It is therefore to be understood that, within the scope of the claims and their equivalents, the invention may be practiced otherwise than as specifically described.

What is claimed is:

1. A container comprising:

a hollow container body comprising at least a first exterior wall having a recess defined therein, the recess being defined by a recess bottom wall extending from an outermost portion of the first exterior wall to a recess back and a recess top wall extending from the recess back to an overhang, and a tab formed integrally with the first exterior wall and located in the recess;

wherein the tab does not extend substantially beyond the recess;

removal of the tab forms an opening in the first exterior wall; and wherein the recess bottom wall extends upward from a front the first exterior wall and forms an angle with respect to said first exterior wall of greater than 90 degrees from the perspective of an interior of the container; and the recess top wall extending downward from the overhang and forming an angle with respect to the overhang of greater than 90 degrees from the perspective of the interior of the container.

2. The container according to claim 1, wherein the tab comprises at least a portion defining a hollow channel contiguous with the hollow container body.

3. The container according to claim 1, wherein the tab is flattened in a plane substantially perpendicular to the first exterior wall.

4. The container according to claim 1, wherein the first exterior wall comprises a substantially planar outermost portion.

5. The container of claim 1, further comprising a right sidewall and a left sidewall attached to opposite sides of the first exterior wall;

wherein the recess extends substantially from the left sidewall to the right sidewall.

6. The container of claim 1, further comprising a top wall, wherein the overhang comprises a portion of the top wall.

7. The container of claim 1 wherein the overhang further comprises a right side portion extending from an overhang front portion to the recess back proximal to a right sidewall and, a left side portion extending from the overhang front portion to the recess back proximal to a left sidewall.

8. The container of claim 1, further comprising a bottom wall, and an outlet in the bottom wall.

9. The container of claim 8, wherein the outlet comprises a finish that includes a structure for securing a closure.

10. A container comprising:

a hollow container body comprising at least a first exterior wall having a recess defined therein, the recess being defined by a recess bottom wall extending from an outermost portion of the first exterior wall to a recess back and a recess top wall extending from the recess back to an overhang, and a tab formed integrally with the first exterior wall and located in the recess;

wherein the tab does not extend substantially beyond the recess;

removal of the tab forms an opening in the first exterior wall; and wherein an overhang front is recessed with respect to the first exterior wall.

11. The container according to claim 10, wherein the tab comprises at least a portion defining a hollow channel contiguous with the hollow container body.

12. The container according to claim 10, wherein the tab is flattened in a plane substantially perpendicular to the first exterior wall.

13. The container according to claim 10, wherein the first exterior wall comprises a substantially planar outermost portion.

14. The container of claim 10, further comprising a right sidewall and a left sidewall attached to opposite sides of the first exterior wall;

wherein the recess extends substantially from the left sidewall to the right sidewall.

15. The container of claim 10, further comprising a top wall, wherein the overhang comprises a portion of the top wall.

16. The container of claim 10, wherein the overhang further comprises a right side portion extending from an overhang front portion to the recess back proximal to a right sidewall and, a left side portion extending from the overhang front portion to the recess back proximal to a left sidewall.

17. The container of claim 11, further comprising a bottom wall, and an outlet in the bottom wall.

18. The container of claim 17, wherein the outlet comprises a finish that includes a structure for securing a closure.

* * * * *